US006776111B2

(12) United States Patent
Lee et al.

(10) Patent No.: US 6,776,111 B2
(45) Date of Patent: Aug. 17, 2004

(54) BOBBIN CASE OF ROTARY SHUTTLE DEVICE FOR SEWING MACHINE

(75) Inventors: Sang Cheol Lee, Seoul (KR); Sung Il Lee, Seoul (KR)

(73) Assignee: Kobest Co., Ltd., Seoul (KR)

( * ) Notice: Subject to any disclaimer, the term of this patent is extended or adjusted under 35 U.S.C. 154(b) by 30 days.

(21) Appl. No.: 10/344,363

(22) PCT Filed: Aug. 27, 2001

(86) PCT No.: PCT/KR01/01443

§ 371 (c)(1),
(2), (4) Date: Feb. 11, 2003

(87) PCT Pub. No.: WO02/18754

PCT Pub. Date: Mar. 7, 2002

(65) Prior Publication Data

US 2003/0167989 A1 Sep. 11, 2003

(30) Foreign Application Priority Data

Aug. 31, 2000 (KR) ..... 2000-51167

(51) Int. Cl.[7] ..... D05B 57/26
(52) U.S. Cl. ..... 112/231
(58) Field of Search ..... 112/229, 230, 112/231, 188, 196

(56) References Cited

U.S. PATENT DOCUMENTS 3,347,193 A * 10/1967 Perri ..... 112/228
3,530,811 A * 9/1970 Kuhar ..... 112/229
3,940,089 A * 2/1976 Lindquist ..... 242/156
4,275,675 A * 6/1981 Killinger ..... 112/229
5,960,728 A * 10/1999 Hirose ..... 112/231

* cited by examiner

*Primary Examiner*—Ismael Izaguirre
(74) *Attorney, Agent, or Firm*—Dykema Gossett PLLC

(57) ABSTRACT

Disclosed is a bobbin case of a rotary shuttle device for a sewing machine, in which an under thread pulled out of a bobbin is continuously and stably supplied to a sewing region. The bobbin case comprises a main body integrally provided with a body, and a side portion which is bent downward at a side of the body to have a thick portion at which a fixing hole and adjusting hole is formed and a think portion at which a first and second supporting portion and a supporting piece for supporting and guiding the under thread are formed, the first and second supporting portions being divided by a boundary portion which is formed with a discharging hole for discharging the under thread pulled out of a bobbin from an inner portion of the side portion to an outside; and a guide member formed with a coupling hole and a controlling hole which is corresponding to the fixing hole and the adjusting hole and through which a fastening bolt and a controlling bolt are releasably screwed, wherein one end of the guide member is also formed with a first fixing piece and a second fixing piece which are respectively fixedly inserted into the first and second supporting hole formed at the side portion of the main body, and the second fixing piece forms a path, through which the under thread is passed, together with the supporting piece.

7 Claims, 5 Drawing Sheets

BOBBIN CASE OF ROTARY SHUTTLE DEVICE FOR SEWING MACHINE

TECHNICAL FIELD

The present invention relates to a sewing machine, and more particularly, a bobbin case of a rotary shuttle device for a sewing machine, which continuously and stably guides and supplies an under thread pulled out of bobbin to a sewing region.

BACKGROUND ART

Generally, an embroidery, domestic or industrial sewing machine, as shown in FIG. 1, has a rotary shuttle device for supplying an under thread. The rotary shuttle device comprises an outer shuttle which is disposed at a driving shaft 1 rotatably connected to a power generating unit, an inner shuttle 3 which is received in the outer shuttle 2, a bobbin 4 which is received in the inner shuttle 3 and on which the under thread is wound, and a bobbin case 5 for receiving the bobbin 4. Recently, in order to wind a large amount of the under thread on the bobbin 4, the bobbin 4 is provided with sidewalls 4*a*, 4*b* respectively formed at both ends thereof and a partition wall 4*c* formed between the sidewalls 4*a*, 4*b* to have a trough portion. According to a construction of the rotary shuttle device as described above, when performing a sewing operation, the outer and inner shuttles 2, 3 are relatively rotated, and at the same time, the under thread wound on the bobbin 4 is pulled out and supplied through the bobbin case 5 and the outer shuttle 2 to a lower portion of cloth to be sewn. Then, the under thread is sewn into the cloth in cooperation with an upper thread supplied from an upper portion of the cloth. At this time, the bobbin case 5 guides the under thread pulled out of the bobbin 4 to the outer shuttle 3 or a sewing region.

As shown in FIG. 2, the bobbin case 5 is comprised of a main body 7 having a discharging hole 6 for discharging the under thread pulled out of the bobbin 4, and a guide member 8 which is formed in the shape of a leaf spring type to guide the under thread discharged through the discharging hole 6 of the main body 7 and also prevent separation of the under thread. Meanwhile, the main body 7 is further formed with a circular through hole 7*a*, a rectangular supporting hole 7*b*, a fixing hole 7*c* and an adjusting hole 7*d*. Corresponding to the holes of the main body 7, at a front end side of the guide member 8, there are formed a first supporting piece 8*a* inserted into the through hole 7*a* of the main body 7 and a second supporting piece 8*b* inserted into the supporting hole 7*b*, and also at a rear end side of the guide member 8, there are formed a coupling hole 8*c* for fixing the guide member 8 to the main body 7 and a controlling hole 8*d* formed to be adjacent to the coupling hole 8*c* to adjust elastic force of the guide member 8. In addition, between the constructing portions as described above, there is formed a guide groove for guiding the under thread. Of course, a fastening bolt 9*a* is fastened through the coupling hole 8*c* into the fixing hole 7*c*. A controlling bolt 9*b* is also screwed into the controlling hole 8*d*. Then, the controlling bolt is tightened or loosened to properly control the elastic force of the guide member 8. In case the bobbin is used in the embroidery sewing machine, an outlet port may be formed at a proper place of the main body 7 so that the under thread can substantially get out of the main body 7. Further, at the discharging hole 6 of the main body 7 is formed a "¬" shaped groove 6*a* for guiding the under thread to the discharging hole 6.

According to the construction as described above, the under thread pulled out of the bobbin 4 goes out of the discharging hole 6 of the main body 7 and passes between a side portion of the main body 7 and the guide member 8, or is then supplied through the outlet port formed at the main body to the outer shuttle 2. At this time, the under thread substantially gets out of the outlet port (not shown) via a guide trough between the first supporting piece 8*a* and the second supporting piece 8*b* of the guide member 8.

However, the bobbin case constructed as above causes various problems as follows. First, since the under thread pulled out through the discharging hole 6 of the main body 7 is positioned within a range of the partition wall of the bobbin 4 which is rotated at a high speed in the main body 7, the under thread is damaged, and in the worst case, cut by the partition wall.

Secondly, since the guide trough formed among the constructing portions of the guide member has a wide guide region, a moving and fluctuating extent of the under thread is increased. Therefore, there is a problem that the under thread is not precisely and stably supplied to the outlet portion of the main body.

Thirdly, the under thread pulled out of the bobbin 4 cannot maintains proper tensile force due to the above problems. Further, intermittent phenomenon and intermittent sound are generated when supplying the under thread, thereby lowering the quantity of sewn products and also reducing stillness in an operation of the sewing machine.

Additionally, a groove for inserting the under thread into the discharging hole is curved. Therefore, there is other problem that it is difficult to insert the under thread into the discharging hole.

DISCLOSURE OF THE INVENTION

Therefore, it is an object of the present invention to provide a bobbin case of a rotary shuttle device for a sewing machine, which is capable of preventing damage or cut of a under thread passing through a main body from a bobbin.

It is other object of the present invention to provide a bobbin case of a rotary shuttle device for a sewing machine, which is capable of deviating the under thread passing through a discharging hole of the main body from the range of a partition wall of a bobbin rotated in the main body.

It is another object of the present invention to provide a bobbin case of a rotary shuttle device for a sewing machine, by which the under thread is pulled out of a bobbin through an optical region of a guide member, while maintaining optical tensile force.

It is yet another object of the present invention to provide a bobbin case of a rotary shuttle device for a sewing machine, in which the under thread can be stably supplied and the sewing machine can be silently operated, thereby increasing the quality of sewn products.

It is yet another object of the present invention to provide a bobbin case of a rotary shuttle device for a sewing machine, which is capable of facilely inserting one end of the under thread wound on the bobbin into the discharging hole.

To accomplish the above objects and advantages, there is provided a bobbin case of a rotary shuttle device for a sewing machine, in which a bobbin for winding an under thread is rotatably disposed, comprising a main body integrally provided with a body, and a side portion which is bent downward at a side of the body to have a thick portion at which a fixing hole and adjusting hole is formed and a think portion at which a first and second supporting portion and a supporting piece for supporting and guiding the under thread are formed, the first and second supporting portions being divided by a boundary portion which is formed with a discharging hole for discharging the under thread pulled out of a bobbin from an inner portion of the side portion to an outside; and a guide member formed with a coupling hole and a controlling hole which is corresponding to the fixing hole and the adjusting hole and through which a fastening bolt and a controlling bolt are releasably screwed, wherein one end of the guide member is also formed with a first fixing piece and a second fixing piece which are respectively fixedly inserted into the first and second supporting hole formed at the side portion of the main body, and the second fixing piece forms a path, through which the under thread is passed, together with the supporting piece.

BRIEF DESCRIPTION OF THE DRAWINGS

The above object, other features and advantages of the present invention will become more apparent by describing the preferred embodiment thereof with reference to the accompanying drawings, in which.

BEST MODE FOR CARRYING OUT THE INVENTION

Now, preferred embodiments of the present invention will be described in detail with reference to the annexed drawings.

Figure 1:
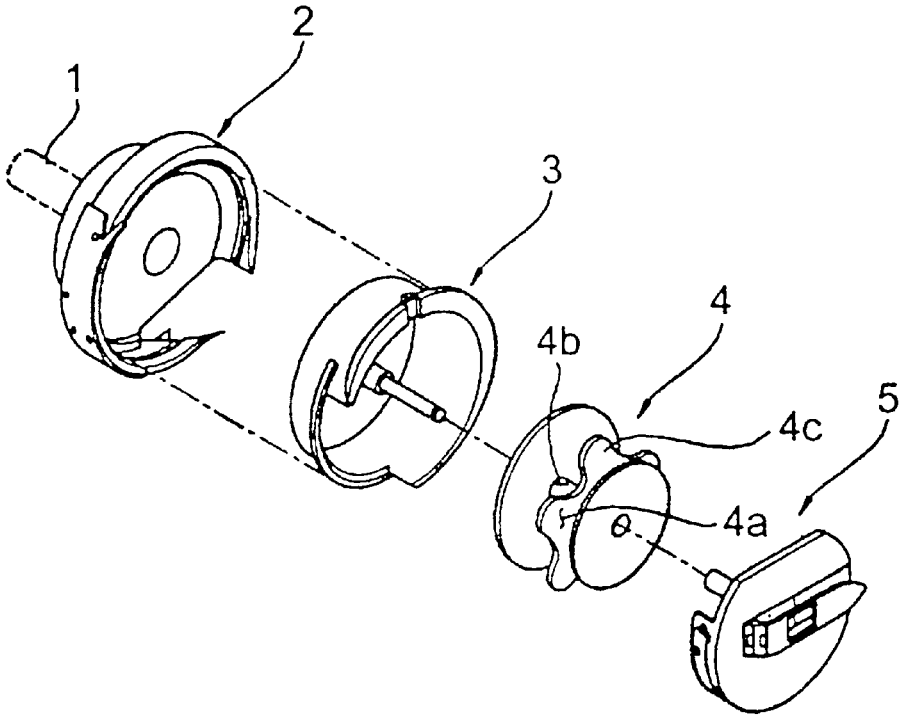
FIG. 1 is an exploded perspective view of a conventional rotary shuttle device for a sewing machine.
Figure 2:
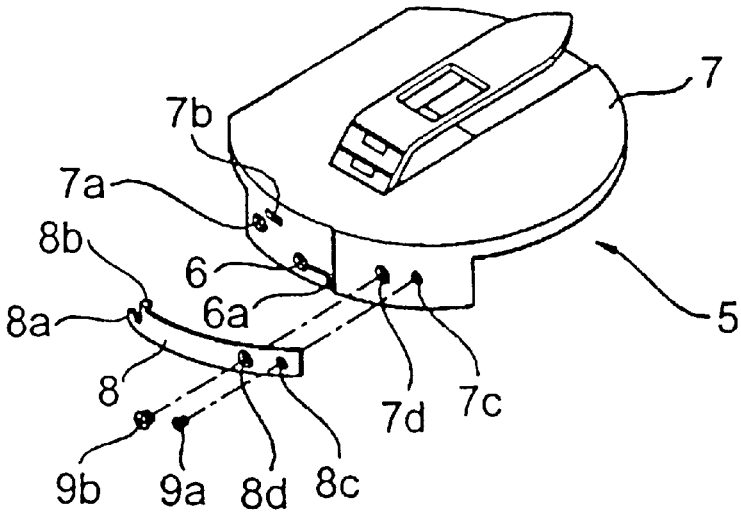
FIG. 2 is an exploded perspective view of a bobbin case of a rotary shuttle device for a sewing machine of FIG. 1.
Figure 3:
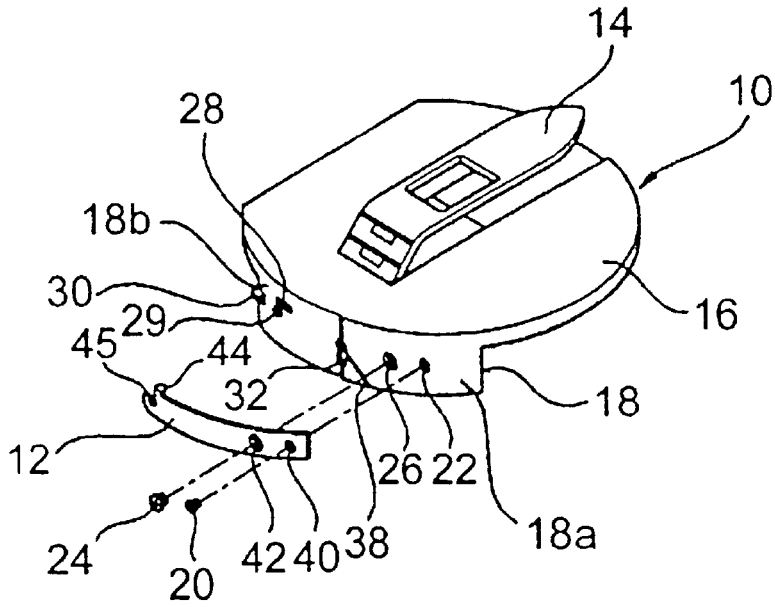
FIG. 3 is an exploded perspective view of a bobbin case of an outer shuttle of the rotary shuttle device according to the present invention.
Figure 4:
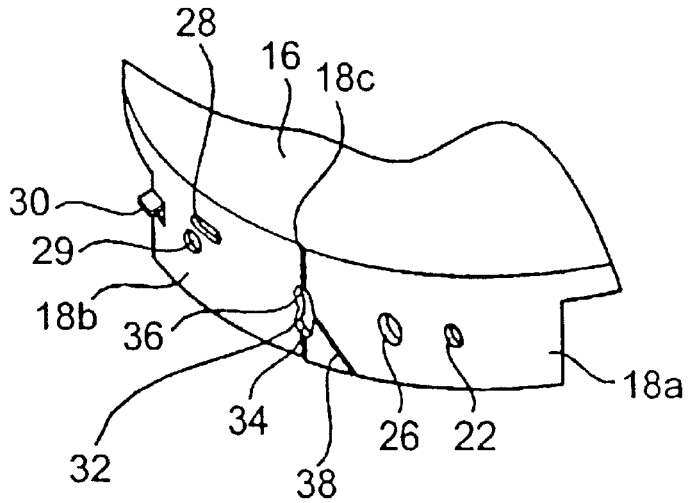
FIG. 4 is a partially cut away view of a portion of a main body of the bobbin case in FIG. 3.

Referring to FIGS. 3 and 4, a bobbin case of a rotary shuttle device according to the present invention basically comprises a main body 10 in which a bobbin is rotatably disposed, and a guide member 12 for guiding an under thread pulled out of the bobbin in the main body 10.

The main body 10 is integrally provided with a body portion 16 that is formed in the shape of a circular plate on the whole and has a grip portion 14 pivotally disposed on the body portion 16, and a side portion 18 that is extended downward at a portion of the body portion 16 to have a desired length. Particularly, the side portion 18 is formed with a thick portion 18*a* and a thin portion 18*b* for workability and stiffness thereof. The thick portion 18*a* and the thin portion 18*b* are divided by a boundary portion 18*c*. The boundary portion 18*c* is formed in the shape of a step portion due to a difference in thickness or height between the thick portion 18*a* and the thin portion 18*b*. Meanwhile, even though not shown in figures, those skilled in the art will appreciate that an embroidery sewing machine has an outlet port through which the under thread of the main body is passed.

At the thick portion 18*a* of the side portion 18, there are formed a fixing hole 22 for fixing the guide member 12 using a fastening bolt 20, and an adjusting hole 26 in which a controlling bolt 24 for controlling elastic force of the guide member 12 is fastened. Further, at the thin portion 18*b* of the side portion 18, there are formed a first and second supporting hole 28, 29 for supporting a fixing piece formed at an end of the guide member 12. Particularly, at an end of the thin portion 18*b* of the side portion 18, there is formed a supporting piece 30 for supporting and guiding the under thread. The supporting piece 30 functions to guide and support the under thread so that the under thread pulled out of the bobbin is passed between the guide member 12 and the side portion 18 and then precisely supplied to a desired sewing position. Preferably, the second supporting hole 29 and the supporting piece 30 are identical with an extended line of an outer circumference of a partition wall 4*c* of the bobbin 4, and further the supporting piece 30 is formed by vertically and horizontally cutting an end of the thin portion 18*b* and then bending the cut end of the thin portion 18*b*. Therefore, between the second fixing piece of the guide member 12 and the supporting piece 30 formed at the thin portion 18*b* of the side portion 18 of the main body 10, as described below, there is formed or defined an under thread path. Of course, it is preferred that both sides of the supporting piece 30 is rounded so that the under thread is smoothly passed.

Meanwhile, the boundary portion 18*c* of the side portion 18 is formed with a discharging hole 32 through which the under thread pulled out of the bobbin is discharged from an inner portion of the side portion 18 to an outside. Particularly, as shown, in FIG. 4, the discharging hole 32 formed at the boundary portion 18*c* of the side portion 18 of the main body 10 is formed with two discharging openings so as to discharge the under thread without any damage or cut of the under thread. That is, at both sides of the discharging hole 32, there are formed a first discharging opening 34 and a second discharging opening 36 corresponding to the first discharging opening 34 so that the under thread can be selectively and essentially passed therethrough according to a position of the under thread pulled out of the bobbin. Preferably, each of the discharging openings 34, 36 is formed at the boundary portion 18*c* or the thin portion 18*b* adjacent to the boundary portion, and further the discharging openings 34, 36 are symmetrically formed with the partition wall 4*c* of the bobbin 4 in the center.

Particularly, it is preferred that the discharging openings 34, 36, through which the under thread is discharged, is formed to be deviated from a rotating range of the partition wall 4*c* of the bobbin 4 so that the under thread 34, 36 passing through the discharging opening 34, 36 is not contacted with the partition wall 4*c* of the rotating bobbin 4, thereby preventing the under thread from being damaged or cut by the partition wall 4*c* of the bobbin 4. Further, it is preferred that each discharging opening 34, 36 is rounded or curved so that the under thread is smoothly discharged.

Meanwhile, a guide groove 38 is communicated with the discharging hole 32 so as to facilely insert an end of the under thread pulled out of the bobbin at the early stage. Preferably, the guide groove 38 is formed in the shape of a diagonal line or an oblique line so as to facilely and rapidly insert the under thread through the discharging groove 38 into the discharging groove 32.

Figure 6:
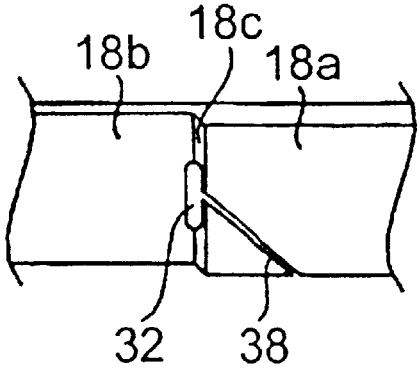
FIG. 6 is a side view of a discharging hole of the bobbin case according to other embodiment of the present invention.

In this embodiment, the discharging openings are formed to diverge each other. However, those skilled in the art will appreciate that the discharging openings can be formed in various other shapes so as to deviate from the rotating range of the partition wall of the bobbin. For example, in case of a bobbin in which the partition wall is not formed at a center portion thereof, as shown in FIG. 6, the discharging hole 32 may be formed in the shape of a linear line or an elongated hole.

Referring to FIG. 3, the guide member 12 is basically formed with a coupling hole 40 and a controlling hole 42 which is corresponding to the fixing hole 22 and the adjusting hole 26 and through which a fastening bolt 20 and a controlling bolt 24 are releasably screwed. At one end of the guide member 12, there are formed a first fixing piece 44 which is fixedly inserted into the first supporting hole 28 formed at the side portion of the main body 10 and a second fixing piece 45 which is fixedly inserted into the second supporting hole 29, thereby preventing separation of the guide member 12 from the main body 10. Further, the first fixing piece 44 restricts a range that the under thread is pulled out or a part of the range together with the supporting piece 30.

Figure 7:
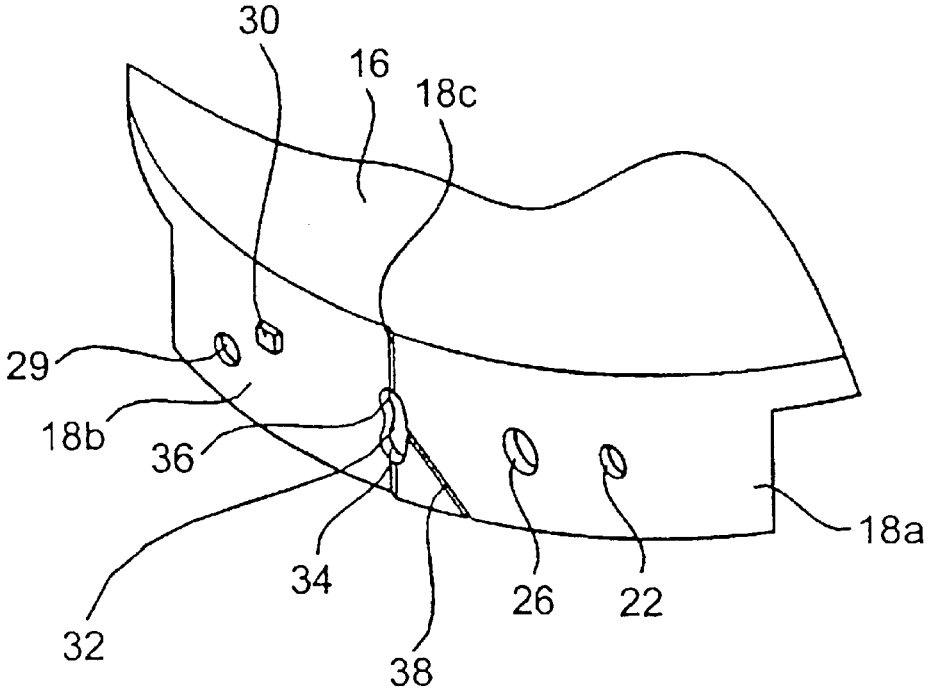
FIG. 7 is a partially cut away view of the main body of the bobbin case according to another embodiment of the present invention.

FIG. 7 is a partially enlarged perspective view of the main body of the bobbin case according to other embodiment of the present invention. The supporting piece 30 for supporting the under thread is integrally formed with the first supporting hole 28. One end of the supporting piece 30 is positioned at the same distance from the first and second discharging openings 34, 36. Meanwhile, the guide member 12 is closely contacted with an outer face of the supporting piece 30 to form a space through which the under thread is passed. In this case, it is preferred that the supporting piece 30 is formed at a position of the first supporting hole 28 by an embossing process.

Hereinafter, an operating mode of the bobbin case of the rotary shuttle device for the sewing machine according to the present invention will be described fully.

For example, if a user operates the sewing machine to perform a sewing operation, the under thread pulled out of the bobbin 4 of the rotary shuttle is discharged through the discharging hole 32 of the main body 10. At this time, the under thread passing through the discharging hole 32 is discharged through the first discharging opening 34 or the second discharging opening 36 according to a position that the under thread is pulled out of the bobbin 4. Therefore, the under thread is deviated from the rotating range of the partition wall 4*c* so as to prevent the under thread from being contacted with the partition wall 4*c* and thus completely prevent the damage or cut of the under thread.

Figure 5A:
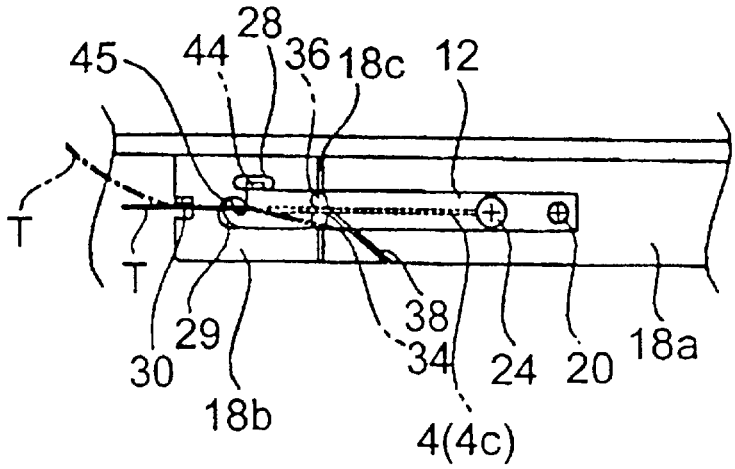
FIGS. 5*a* and 5*b* are partially enlarged views showing a state that an under thread is discharged through the assembled bobbin case according to the present invention.
Figure 5B:
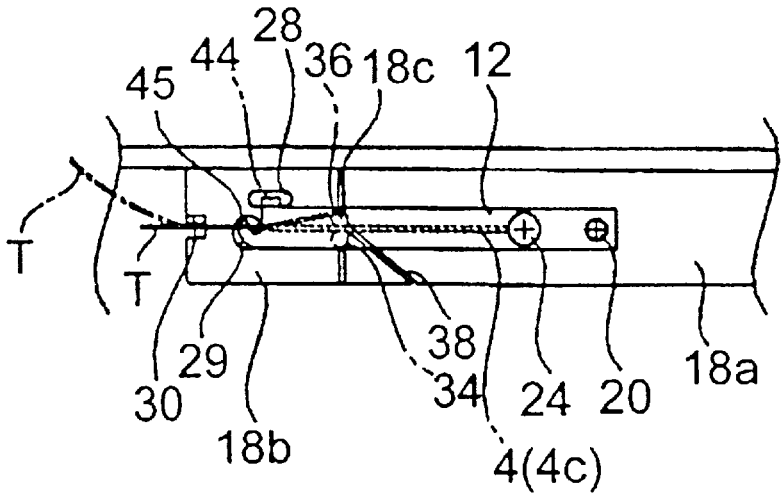

In more detail, in case the under thread is discharged from a winding portion of the bobbin 4, which has a relatively large area, the under thread T is discharged through only the first discharging opening 34 of the discharging hole 32 (referring to FIG. 5*a*). On the contrary, in case the under thread is discharged from the winding portion having a relatively small area, the under thread T is discharged through only the second discharging opening 36 of the discharging hole 32 (referring to FIG. 5*b*).

In addition, the under thread, which is discharged through one of the discharging openings of the discharging hole 32, passes between the guide member 12 and the thin portion 18*b* of the side portion 18 of the main body 10 and gets out through a under thread path formed between the second fixing piece 45 of the guide member 12 and the thin portion 18*b* of the side portion of the main body 10. At this time, since the under thread is discharged through only a range of the under thread path or a range of the under thread path defined by the fixing piece and the supporting piece, the under thread is linearly discharged (a solid line) or discharged at an optimal inclined angle (a dotted line) toward the sewing region, whereby the under thread has always constant tensile force while being supplied. Moreover, since the first supporting hole 29 and the supporting piece 30 are placed to be identical with the extended line of the outer circumference of the partition wall 4*c* of the bobbin 4, and positioned at the same distance from the first and second discharging openings 34, 36, the tensile force applied to the under thread is constantly maintained. Accordingly, the under thread can be freely moved between the first and second discharging openings 34, 36. The tensile force of the under thread can be properly adjusted by controlling the elastic force of the guide member 12 using the controlling bolt 24.

Meanwhile, an operation of the bobbin case of the rotary shuttle device for the sewing machine 20 according to another embodiment of the present invention is described in detail.

Figure 8A:
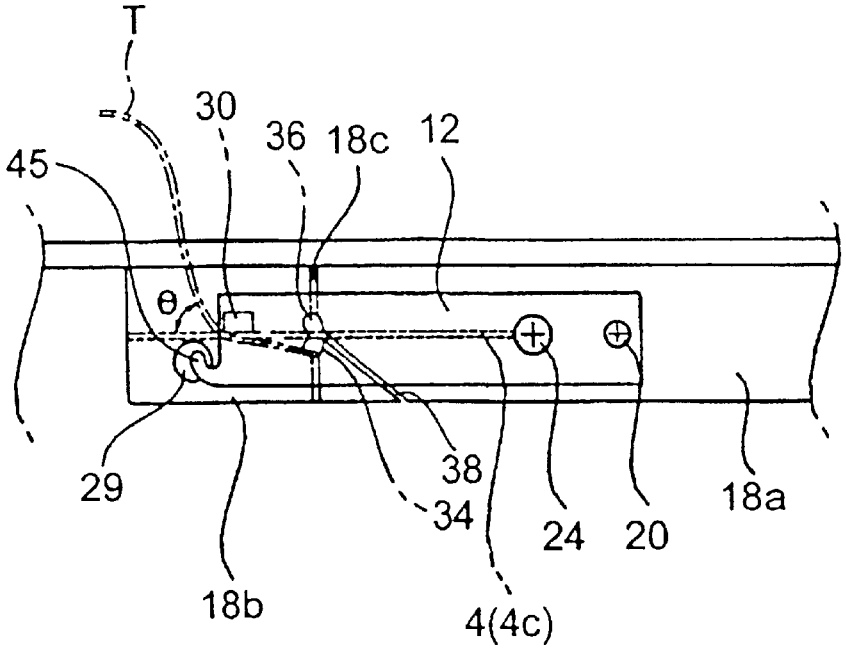
FIGS. 8*a* and 8*b* are partially enlarged views showing a state that the under thread is discharged through the assembled bobbin case in FIG. 7.
Figure 8B:
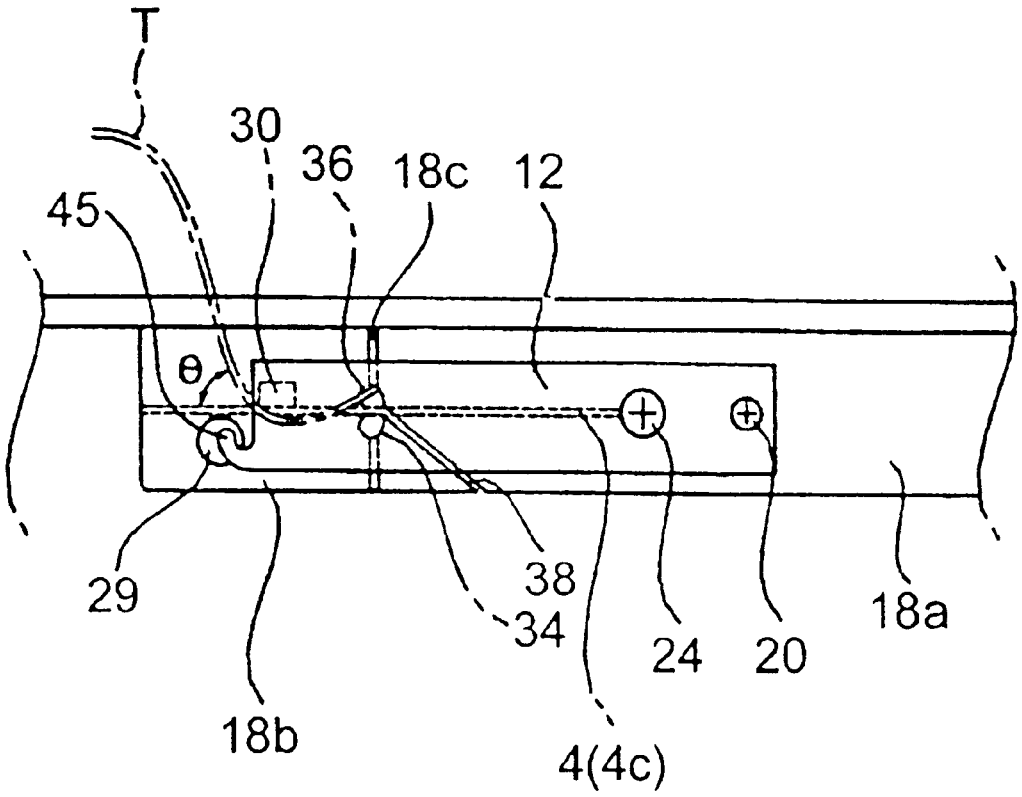

FIGS. 8*a* and 8*b* are partially enlarged views showing a state that the under thread is discharged through the assembled bobbin case in FIG. 7. The under thread T passed through the discharging opening of the discharging hole 32 gets out at a desired discharging angle θ through a path formed between the second fixing piece 45 of the guide member 12 and the supporting piece 30 formed at the thin portion 18*b* of the side portion 18 in the embossed shape. At this time, one side of the supporting piece 30 is identical with the extended line of the outer circumference of the partition wall 4*c* of the bobbin 4, and is positioned at the same distance from the first and second discharging opening 34, 36 so as to always maintain the constant tensile force regardless of the position of the under thread. In this embodiment, since the discharging angle θ is smaller than that of other embodiments as well as a conventional bobbin case, the tensile force applied to the under thread T is reduced, thereby preventing the under thread T from being cut. Further, since the path of the under thread T is tightly closed by the space formed by the thin portion 18*b* and the guide member 12 and the space formed by the supporting piece 30 and the second fixing piece 45, it is also prevented that the under thread is separated.

Thus, the under thread pulled out of the bobbin is discharged through the bobbin case with an optimal direction and tensile force being maintained, and then supplied to the sewing region, thereby facilely performing the sewing operation.

According to the bobbin case of the rotary shuttle device for the sewing machine of the present invention, when the under thread wound on the bobbin is discharged, it is prevented that the under thread is contacted with the partition wall of the bobbin and the under thread is damaged or cut. Further, the under thread is discharged through the under thread path defined between the limited fixing piece of the guide member and the supporting piece and then always supplied in the optimal direction and tensile force.

While the present invention has been described in detail, those skilled in the art will appreciate that various modifications and substitutions can be made thereto without departing from the spirit and scope of the present invention as set forth in the appended claims.

What is claimed is:

1. A bobbin case of a rotary shuttle device for a sewing machine, in which a bobbin for winding an under thread is rotatably disposed, comprising;

a main body integrally provided with a body, and a side portion downwardly bent at a side of the body to form a thick portion at which a fixing hole and an adjusting hole is formed, and a thick portion at which a first and second supporting hole and a supporting piece for supporting and guiding the under thread are formed, the first and second supporting portions being divided by a boundary portion which is formed with a discharging hole for discharging the under thread pulled out of a bobbin from an inner portion of the side portion to an outside;

a guide member formed with a coupling hole and a controlling hole which corresponds to the fixing hole and the adjusting hole and through which a fastening bolt and a controlling bolt are releasably screwed, wherein one end of the guide member is also formed with a first fixing piece and a second fixing piece which are respectively fixedly inserted into the first and second supporting hole formed at the side portion of the main body, and the second fixing piece forms a path, through which the under thread is passed, together with the supporting piece and wherein the discharging hole is formed with a first discharging opening and a second discharging opening through which the under thread pulled out of the bobbin is selectively passed according to a position of the under thread.

2. The bobbin case of claim 1, wherein the discharging openings of the discharging hole is formed at the boundary portion of the side portion, while keeping a distance from the guide member.

3. The bobbin case of claim 1, wherein each of the discharging openings is disposed to be deviated from a rotating range of the partition wall if the bobbin is disposed in the main body and has the partition wall.

4. The bobbin case of claim 1, wherein the discharging hole is communicated with a guide groove which is diagonally formed from a side of the thick portion to a center portion of the discharging hole so as to insert an end of the under thread into the discharging hole at an early stage.

5. The bobbin case of claim 1, wherein a side end of the supporting piece, through which the under thread is passed, is positioned at the same distance from the first and second discharging opening.

6. A bobbin case of a rotary shuttle device for a sewing machine, in which a bobbin for winding an under thread is rotatably disposed, comprising;

a main body integrally provided with a body, and a side portion downwardly bent at a side of the body to form a thick portion at which a fixing hole and an adjusting hole is formed, and a thick portion at which a first and second supporting hole and a supporting piece for supporting and guiding the under thread are formed, the first and second supporting portions being divided by a boundary portion which is formed with a discharging hole for discharging the under thread pulled out of a bobbin from an inner portion of the side portion to an outside;

a guide member formed with a coupling hole and a controlling hole which corresponds to the fixing hole and the adjusting hole and through which a fastening bolt and a controlling bolt are releasably screwed, wherein one end of the guide member is also formed with a first fixing piece and a second fixing piece which are respectively fixedly inserted into the first and second supporting hole formed at the side portion of the main body, and the second fixing piece forms a path, through which the under thread is passed, together with the supporting piece and wherein the discharging hole is formed in the shape of an elongated hole.

7. A bobbin case of a rotary shuttle device for a sewing machine, in which a bobbin for winding an under thread is rotatably disposed, comprising;

a main body integrally provided with a body, and a side portion downwardly bent at a side of the body to form a thick portion at which a fixing hole and an adjusting hole is formed, and a thick portion at which a first and second supporting hole and a supporting piece for supporting and guiding the under thread are formed, the first and second supporting portions being divided by a boundary portion which is formed with a discharging hole for discharging the under thread pulled out of a bobbin from an inner portion of the side portion to an outside;

a guide member formed with a coupling hole and a controlling hole which corresponds to the fixing hole and the adjusting hole and through which a fastening bolt and a controlling bolt are releasably screwed, wherein one end of the guide member is also formed with a first fixing piece and a second fixing piece which are respectively fixedly inserted into the first and second supporting hole formed at the side portion of the main body, and the second fixing piece forms a path, through which the under thread is passed, together with the supporting piece and wherein the supporting piece is integrally formed with the first supporting hole, and closely contacted with a side of the guide member.

* * * * *